US008482405B1

(12) United States Patent
Pierce et al.

(10) Patent No.: US 8,482,405 B1
(45) Date of Patent: Jul. 9, 2013

(54) HEALTH MONITORING SYSTEM FOR PERSONNEL ON A HIGH SPEED BOAT

(75) Inventors: Eric C. Pierce, Panama City Beach, FL (US); Jeffery Blankenship, Panama City, FL (US); Brian L. Price, Panama City Beach, FL (US); Eric Tuovila, Panama City, FL (US); Ronald S. Peterson, Panama City Beach, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 779 days.

(21) Appl. No.: 12/798,167

(22) Filed: Mar. 15, 2010

(51) Int. Cl.
*G08B 1/08* (2006.01)

(52) U.S. Cl.
USPC ..... 340/539.12; 340/10.1; 340/332; 340/573.1; 340/573.6; 340/539.13; 340/539.26; 340/984; 441/80; 441/88; 441/89; 342/357.22

(58) Field of Classification Search
USPC ..... 340/539.12, 10.1, 332, 573.1, 573.6, 340/539.13, 539.26, 984; 441/80, 88, 89; 342/357.22
See application file for complete search history.

(56) References Cited

U.S. PATENT DOCUMENTS

| | | | | |
|---|---|---|---|---|
| 4,714,914 | A * | 12/1987 | Boe | 340/573.1 |
| 5,059,952 | A * | 10/1991 | Wen | 340/573.6 |
| 5,192,238 | A * | 3/1993 | Brown | 441/84 |
| 5,408,238 | A * | 4/1995 | Smith | 342/357.55 |
| 5,463,598 | A * | 10/1995 | Holland et al. | 367/131 |
| 5,886,635 | A * | 3/1999 | Landa et al. | 340/573.6 |
| 6,057,759 | A * | 5/2000 | Marsh | 340/539.11 |
| 6,222,484 | B1 * | 4/2001 | Seiple et al. | 342/357.55 |
| 7,125,298 | B1 * | 10/2006 | Frank | 441/11 |
| 7,156,036 | B2 * | 1/2007 | Seiple | 114/254 |
| 7,176,832 | B2 * | 2/2007 | Bruno et al. | 342/357.31 |
| 7,195,369 | B2 * | 3/2007 | Shaw | 362/108 |
| 7,335,077 | B2 * | 2/2008 | Chiappetta | 441/80 |
| 7,695,335 | B2 * | 4/2010 | Ricciuti et al. | 441/89 |
| 7,855,654 | B2 * | 12/2010 | Katz | 340/573.6 |
| 8,253,576 | B2 * | 8/2012 | Witzel et al. | 340/600 |
| 2004/0123793 | A1 * | 7/2004 | Jakubowski, Jr. | 116/210 |
| 2004/0233041 | A1 * | 11/2004 | Bohman et al. | 340/10.1 |
| 2005/0040987 | A1 * | 2/2005 | Bruno et al. | 342/357.08 |
| 2006/0254491 | A1 * | 11/2006 | Seiple | 114/253 |
| 2008/0297341 | A1 * | 12/2008 | McClanahan | 340/539.13 |
| 2009/0096586 | A1 * | 4/2009 | Tubb | 340/10.33 |
| 2009/0158635 | A1 * | 6/2009 | Hope | 43/4.5 |
| 2009/0219160 | A1 * | 9/2009 | Shervey et al. | 340/573.6 |
| 2010/0309315 | A1 * | 12/2010 | Hogasten et al. | 348/164 |

* cited by examiner

*Primary Examiner* — Benjamin C Lee
*Assistant Examiner* — Quang D Pham
(74) *Attorney, Agent, or Firm* — James T Shepherd

(57) ABSTRACT

The invention is a health monitoring system that determines the spine stress dose value for an individual on a high speed boat. The boat can produce impact injury from whole-body vibration embedded with multiple shocks. The system includes an RFID tag; a GPS; a display; a RFID reader; a multi-axis sensor unit that is an accelerometer which enables the determination of impact, vibration and shock, impact and vibration; and a central data acquisition apparatus. The apparatus includes processors in communication with the GPS, the sensor unit, and the RFID reader. The apparatus samples the RFID reader frequently, confirming the status of all individuals having RFID tags as being onboard or overboard. An application records a GPS location and time if an individual is overboard, and generates a course to the GPS location. The display illustrates a ride roughness graphically, in terms of injury potential at a particular speed and heading.

18 Claims, 4 Drawing Sheets

HEALTH MONITORING SYSTEM FOR PERSONNEL ON A HIGH SPEED BOAT

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to health monitoring systems, and in particular to health monitoring systems for personnel on a boat, where the boat is capable of operating at high speeds and can be deployed in warfare special operations.

2. Prior Art

Advancements in high speed craft (HSC) construction and powering technology have led to ever-increasing craft speed and increasing numbers of reported impact injuries. The military HSC impact injury problem is particularly insidious since, unlike their civilian high speed pleasure craft and offshore racing counterparts, military crewmen must operate their craft at high speed in rough seas to fulfill their mission and, at times, to survive. Further, as military craft, the crewmen generally agree that they must "train as they fight." A critical objective within a human-centered approach to HSC acquisition is to reduce the incidence of impact injury.

Ron Peterson et al. in an article entitled "Evaluation of Criteria for Assessing Risk of Impact Injury in High Speed Craft" published Feb. 3, 2006, reports that Gollwitzer and Peterson [Gollwitzer, R. M., and Peterson, R. S., (1994) Shock Mitigation on Naval Special Warfare High Speed Planing Boats Technology Assessment, Report CSS/TR-94/33, Dahlgren Division, Naval Surface Warfare Center, Panama City, Fla.] described the effects of repeated shock impacts on occupants during high speed operations in Naval Special Warfare boats. Ensign et al. [Ensign, W., Hodgdon, J., Prusaczyk, K., Ahlers, S., Shapiro, D., and Lipton, M., (2000) A Survey of Self-Reported Injuries Among Special Boat Operators, Report TR 00-48, Naval Health Research Center] found compelling evidence of a significant injury problem in a study of self-reported injuries of high speed boat operators. It was found that 65% of operators responding to the survey sustained boat-related injury, with 89% of these within the first two years of operation. This injury problem is both acute and chronic, reducing both the short-term and the long-term effectiveness of personnel who are exposed to repeated shock impacts.

Sea trials performed in January 2003, October 2003, and January 2005 provide data upon which the relative performance of discomfort methods (RMS, ISO 2631 Part 1 (1985), and ISO 2631 Part 1 (1997) VDV) and injury assessment methods (ISO 2631 P5) may be evaluated. In these sea trials, boat deck, seats, human volunteers and Hybrid III anthropomorphic test dummies were instrumented with tri-axial accelerometers and tri-axial angular rate sensors. The Hybrid III dummies also contained lumbar and cervical spine load cells. The RMS, ISO 2631 Part 1, and ISO 2631 Part 5 were all evaluated at the seat pad of the occupant. However, discomfort and injury relevant to this work is related to accelerations and the corresponding forces of the lumbar spine. Often discomfort is a sign of the initiation of an injury; however this is not always the case. In this study it was found that the RMS of the seat pad accelerations does not account for human spine dynamics, nor does it accurately account for severe discrete events that are common with high speed planing boats, like a Mark V Special Operations Craft (MK V SOC) and Naval Special Warfare Rigid Inflatable Boat (NSW RIB). These high speed craft are capable of speeds of 45 knots and higher. Also, while MK V SOC can have suspended seats, NSW RIBs do not, and the personnel substantially spend most of their time standing.

The ISO 2631 Part 5 is the only existing criterion to include transfer functions for predicting tri-axial lumbar spine accelerations from measured seat pad accelerations. Within the ISO 2631 Part 5 standard, lumbar forces are estimated from the predicted lumbar accelerations. These forces are correlated to a likelihood of injury based upon the ultimate strength of the lumbar spine, the variance of this strength, and probability analysis. Lumbar spine accelerations (which are often approximated by exterior back accelerations corresponding to the L4 lumbar spine) and the measured lumbar spinal forces in the Hybrid III dummies can be compared to predicted values from the ISO 2631 Part 5 as a way to validate the standard.

The ISO 2631 Part 5 is stated as the best injury criterion available to assess impact spine injury on high speed craft. However, injury reference values in the ISO 2631 Part 5 may be too low, especially for military operators. An analysis of predicted and measured lumbar forces, coupled with anecdotal information concerning ride quality from experienced crewmen will help lead to the identification of appropriate injury thresholds for occupants of high speed craft.

SUMMARY OF THE INVENTION

The invention is a health monitoring system for personnel of a high speed boat, which among several aspects the system measures and monitors the spine stress dose value and the shock. The speeding boat can produce impact injury from whole-body vibration embedded with multiple shocks. The system includes a GPS; a RFID tag on an individual, where the RFID tag refers to active and passive RFIDs; a display; a RFID reader; a multi-axis sensor unit that is an accelerometer which enables the determination of impact, vibration and shock; and a central data acquisition apparatus.

The apparatus includes processors in communication with the GPS, the sensor unit, and the RFID reader. The apparatus samples the RFID reader frequently, associating the impact, vibration and shock with the individuals via their RFID tags, and determines that they are either onboard or overboard. An aspect of the invention is an application that records a GPS location and time that contact was lost if one or more of the individuals goes overboard. The application also generates a course back to the GPS location(s) where the one or more individuals went overboard. Another aspect of the invention is that the system graphically displays a quality of ride in terms of injury potential based on the dynamic exposure data at a particular speed and heading.

BRIEF DESCRIPTION OF THE DRAWINGS

The foregoing invention will become readily apparent by referring to the following detailed description and the appended drawings in which.

DETAILED DESCRIPTION OF THE INVENTION

The invention is a health monitoring system for personnel. The system generally includes elements that enable a correlation of impact injury from the cumulative effect of whole-body vibration embedded with multiple shocks with the degree of injury.

Figure 1:
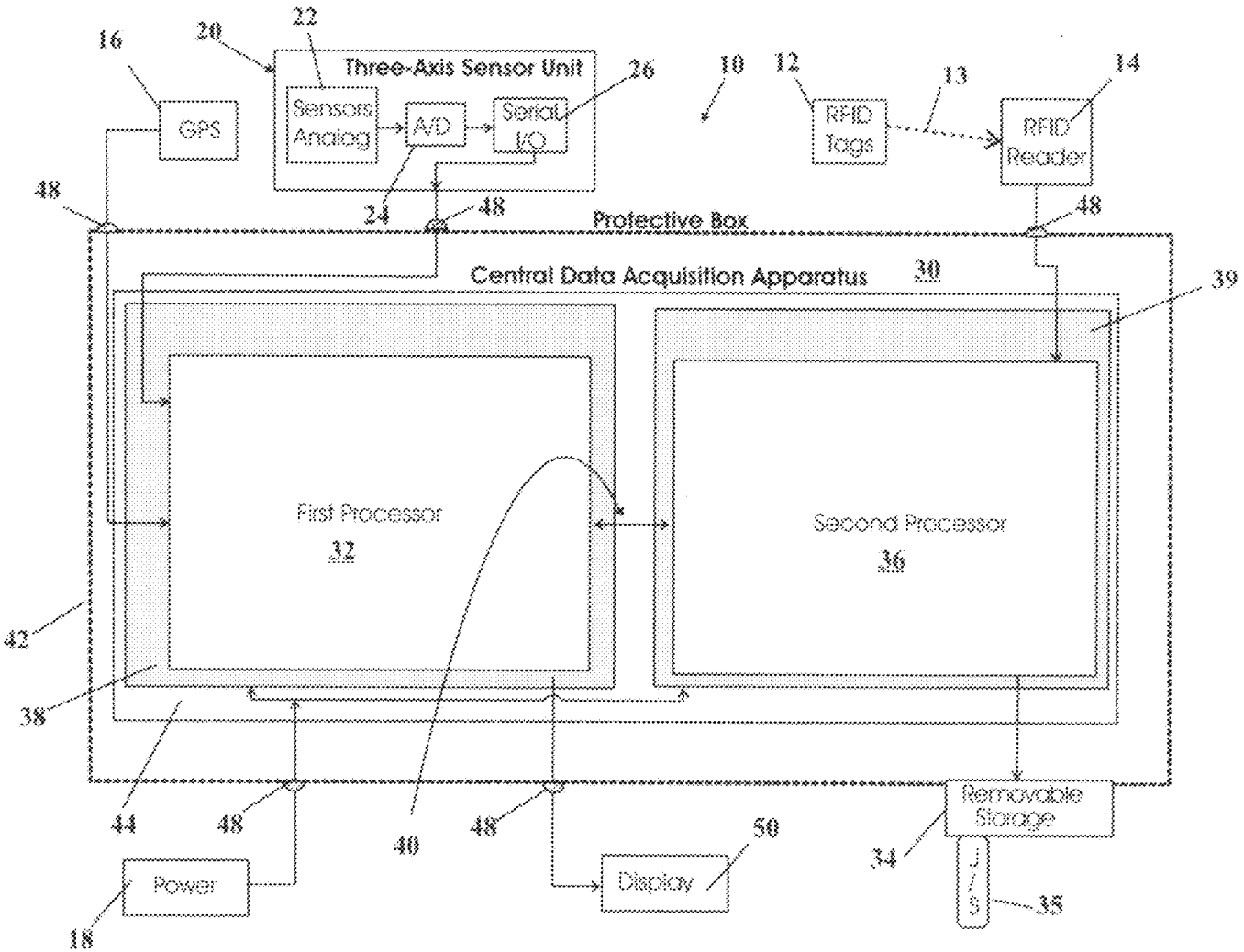
FIG. 1 is a schematic view of a version of the health monitoring system for personnel on a high speed water craft.

Referring to FIG. 1, which is a schematic view of a version of the health monitoring system 10 for one or more individuals on a high speed watercraft, the system includes a radio frequency identification (RFID) tag 12 with a transponder, where the RFID tag is worn by or otherwise attached to and uniquely associated with an individual; a RFID reader 14; a global positioning system (GPS) receiver 16; a display 50; a multi-axis sensor unit 20 which is an accelerometer that measures dynamic exposure (comprised of impact, vibration and shock); and a central data acquisition apparatus 30. The central data acquisition apparatus 30 includes a first processor 32 in communication with the GPS receiver 16, and the multi-axis sensor unit 20. The multi-axis sensor unit 20 quantifies the dynamic exposure at a specified time interval, which may then be correlated to the individual via his RFID. The sampling time interval is relatively short, less than about 10 seconds, and preferably about every 5 seconds or less. A second processor 36 is in communication with the integrated RFID reader 14. The integrated RFID reader reads and confirms a status of all individuals as to being either onboard or overboard. The second processor 36 is in communication with a removable data storage unit 34. It is to be understood that the first and second processor can pass control between each other, and a communication route is not necessarily limited to a single processor. For example, the removable data storage unit 34 could be in communication with the first processor 32 or both processors 32 and 36. The central data acquisition apparatus 30 includes a bus 40 that enables communication between the first processor 32 and the second processor 36.

The processors 32,36 are housed in a protective box 42 that can be mounted on a boat, where the boat is suitable for special naval operations requiring a high speed craft which, during a special operation or training for the special operation, can produce impact injury and exposure to equipment as well as personnel. The protective box 42 is waterproof, impervious to marine elements, and has a resilience to impact that is comparable or better than the resilience of the boat. The disclosed invention has been found to withstand shock of twenty nine times the force of gravity. The ability to withstand shock decreases if moving mechanical elements such as fans and disk drives are used. The protective box is typically composed, at least in part, of a material having good thermal conductivity, such as aluminum and alloys thereof. The box includes a cover (where a cover includes a door, or any closing member) permitting quick access to an interior of the box and to the removable data storage unit. The cover is not shown or numbered. In an alternate embodiment the removable data storage unit 34 is mounted on an exterior of the box.

The central data acquisition apparatus 30 has a passive cooling system for cooling the electronics housed within the protective box. The first processor 32 and the second processor 36 are mounted on a first motherboard 38 and a second motherboard 39, respectively. The motherboards 38,39 are mounted on a base 44, which serves as a heat sink, and in one embodiment the base 44 is a portion of the protective box 42. In another embodiment the base 44 is a component in contact with the box. In both cases, heat is dissipated by the protective box 42.

The central data acquisition apparatus 30 has a plurality of waterproof communication ports 48 comprising electrical connections through the box 42 to an external power supply 18, the display 50, the RFID reader 14, the GPS 16, and the multi-axis sensor unit 20. The multi-axis sensor unit 20 is typically comprised of a three-axis sensor 22 which produces an analog signal. The analog signal is converted into a digital signal by the A/D converter 24, and then serialized by the serial I/O 26, which is passed along to the first processor 32.

The central data acquisition apparatus 30 has a first application that correlates the individual with the dynamic exposure data as measured by the multi-axis sensor unit, and saves the dynamic exposure data on the removable data storage unit 34. A second application records a GPS location and time if one or more of the crew goes overboard, and generates a course back to the location where the one or more individuals went overboard. A third application graphically illustrates on the display a ride roughness in terms of injury potential based on the dynamic exposure data at a particular speed and heading. A fourth application displays an error/status code into a user friendly text message.

The removable data storage unit 34 has at least one USB flash drive 35, where the USB flash drive 35 is generic for a jump stick, a USB memory key, a Cruzer™, a TravelDrive™, a ThumbDrive™, a Disgo™ and the like. The USB flash drive 35 in the preferred embodiment is waterproof. For confidentiality, it is preferred that the dynamic exposure data on the USB flash drive is encrypted.

The transponder of the RFID tag 12 sends out a radio frequency signal, which is detected by the RFID reader. In most cases the signal is transmitted in rapid pulses or continuously so that there is a substantially continuous stream of information. For tactical reasons, if the boat is operating in radio silence, the transponder can be turned off, and then turned back on at the appropriate time. The system may include a transponder control capability that allows the transponder to be turned on and off.

The system typically also includes a web based medical server, where the dynamic exposure data is periodically uploaded therein maintaining an ongoing cumulative dynamic exposure dose level for the individual associated with the RFID. One method of uploading the data is to periodically copy it directly from an unplugged USB flash drive 35 to the web based medical server (not shown or numbered). The cumulative dynamic exposure dose level for the individual can then be analyzed by multiple medical personnel using injury assessment software to monitor the individual's cumulative dose levels and provide medical feedback to operators and their commands. The information can be efficiently disseminated using a private network, or a universal network like the Internet.

Figure 2:
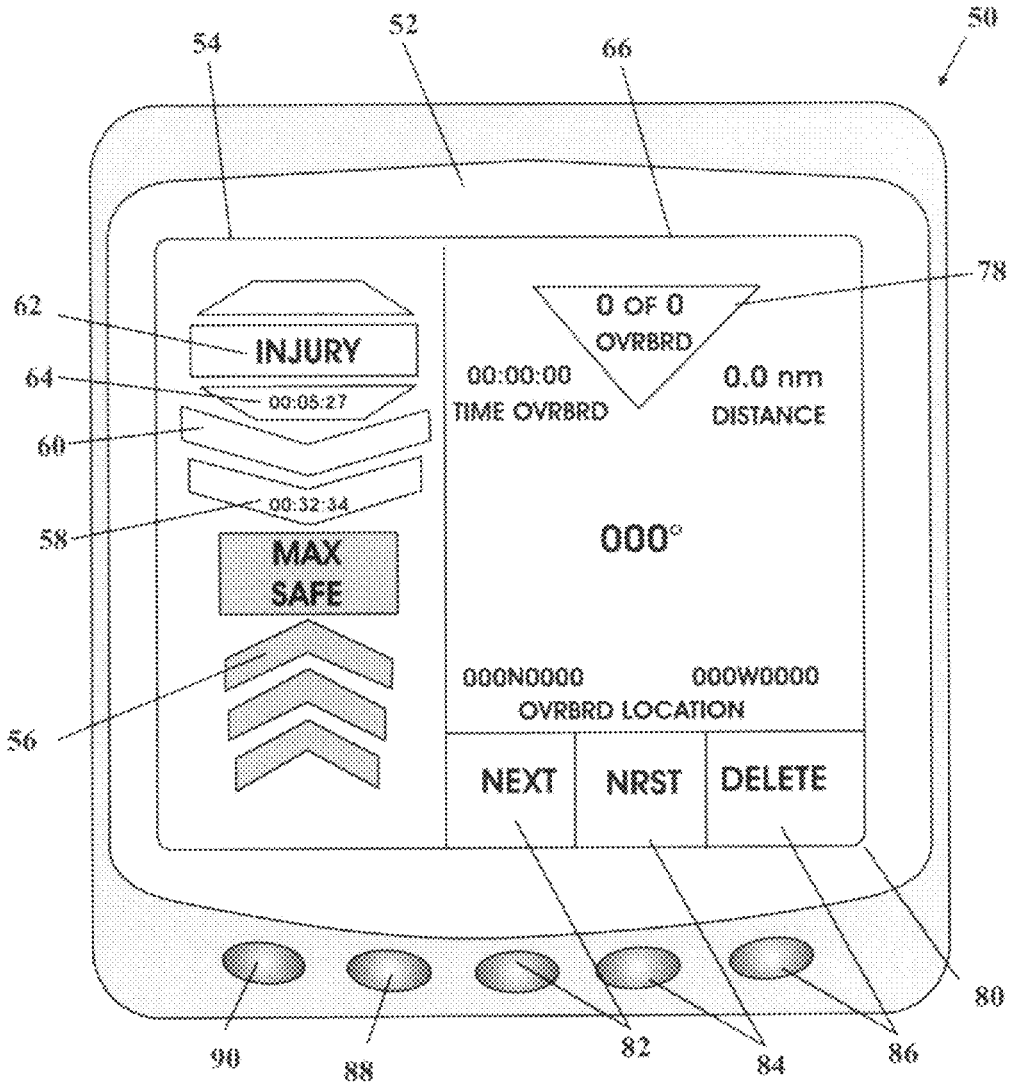
FIG. 2 is a frontal view of the display of the system that graphically illustrates the ride roughness in terms of injury potential based on the dynamic exposure data at a particular speed and heading.

FIG. 2 is a frontal view of the display 50 of the system 10, where the display graphically illustrates the ride roughness in terms of injury potential based on the dynamic exposure data at a particular speed and heading. The display can be operated at various levels of intensity, depending on the ambient light and tactical considerations. In one embodiment the display 50 is night vision goggle compatible, operating at a very low light intensity. The display has three zones marked off on an LCD screen 52. Zone one 54 graphically illustrates the dynamic exposure, or ride quality, using a "Christmas tree" like bar graph. Zone two 66 is activated when the central data acquisition apparatus 30 has determined that it is probable that one or more individuals is overboard. Zone three 80 includes a row of buttons to control the screen intensity and other properties.

Examining zone one 54, there are three regions of ride quality. Safe ride quality 56 is indicated by three chevrons and a rectangle labeled "Max Safe". The elapsed safe ride time 58 is given as 32 minutes and 34 seconds in the illustrated example. Above the rectangle labeled "Max Safe" are two inverted chevrons 60 that indicate that the ride is rougher, caution is to be considered, but not yet causing injury. Above them is an octagon 62 labeled "Injury", indicating that at times the ride quality was poor enough to potentially cause injury. Also shown is the length of time 64 of injurious dynamic exposure. The time 64 of whole-body vibration embedded with multiple shocks with the degree of injury is shown as 5 minutes and 27 seconds in the illustrated example. The injury time is cumulative. The display does not provide the level of detail of data that is stored on the USB flash drives 35, but it gives the helmsman a good indication of the quality of ride, and the officer in charge can make an informed decision as to how fast to push the high speed craft.

Zone two 66 has a dimly lit triangle 78 that indicates that no one is overboard. Buttons 88,90 control the screen intensity, so that it can be viewed with night vision goggles, or brighter or lower. Button 82 activates "Next", Button 84 activates "Nearest", and Button 86 activates "Delete". Since no one is overboard these buttons would not need to be activated.

Figure 3:
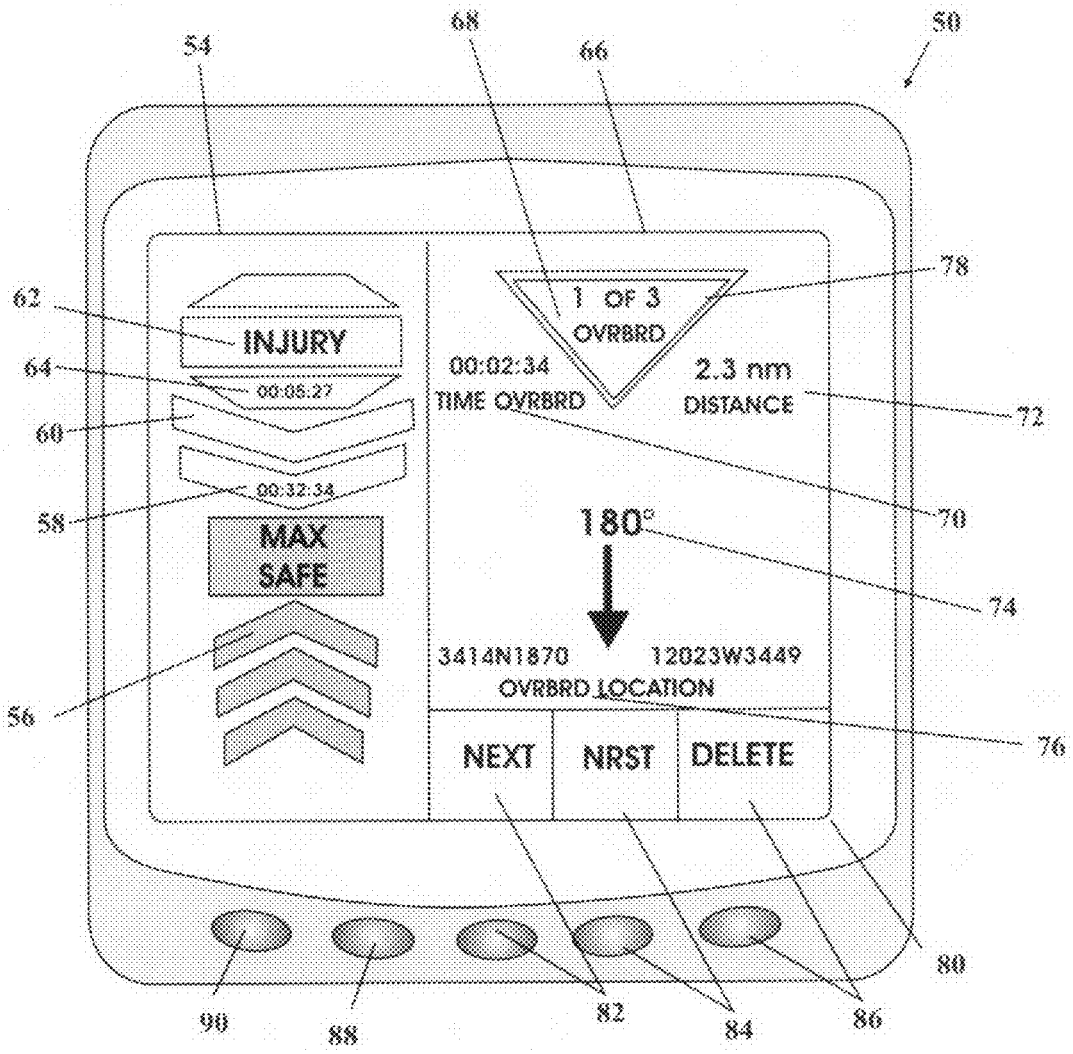
FIG. 3 is a frontal view of the display of the system that provides notification if/when someone is overboard and other information including the GPS location of the boat when the individual went overboard, how much time has elapsed since the individual disembarked, the distance back to the GPS location, and the heading to return.

FIG. 3 is a frontal view of the display 50 of the system 10 that provides notification that one or more individuals are overboard 68 and other information including the location of the boat when they went overboard 76, how much time has elapsed since the crewman disembarked 70, the distance to the location 72, and the heading to return to the location 74. The overboard triangle 78 is lighted up, indicating that three individuals are overboard. The helmsman has the option of selecting the GPS coordinates for the individual who is nearest or one of the others by operating the "Nearest" and "Next" buttons 84, 82 as appropriate. In the illustrated example, the GPS coordinates for the first individual is 3414N1870-12023W3449. The GPS coordinates are in the military format which is the equivalent to the civilian coordinate N 34 14.187 W 120 23.344 (this GPS location is in the Pacific Ocean). The boat is only 2.3 n miles from the first individual, just a little over two minutes away. The helmsman can confirm that the first individual is also the nearest man overboard, as you wouldn't want to pass anybody on the way to picking the first individual up. The display can be set to default to always showing the list by who is nearest 84.

Figure 4:
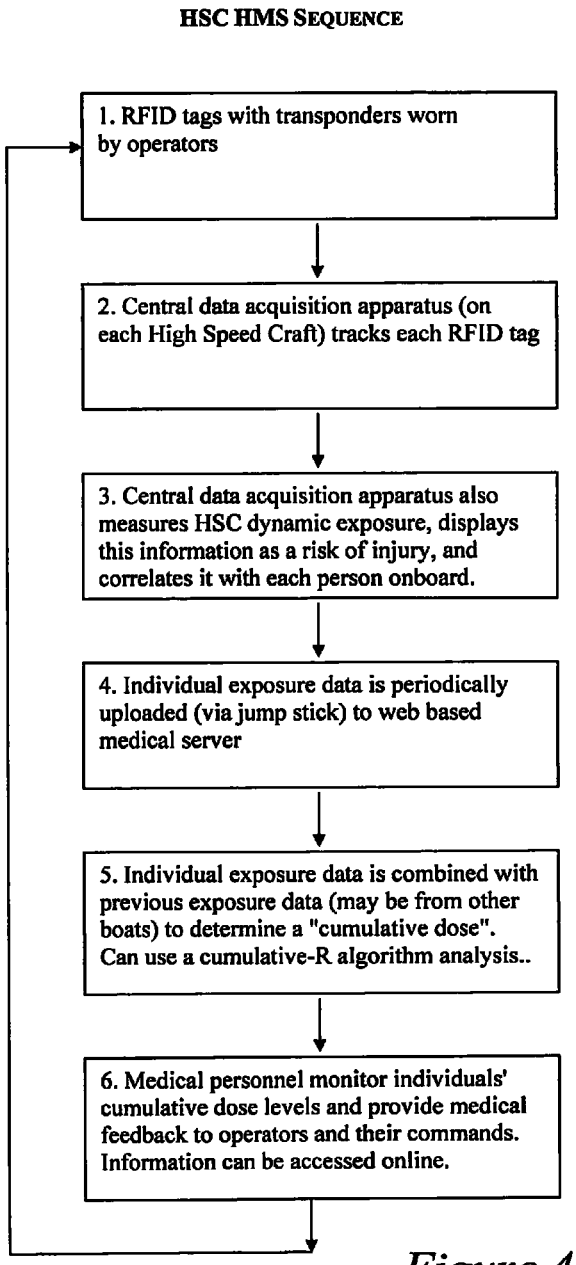
FIG. 4 is a listing of the sequence of the health monitoring system for high speed craft (HMS HSC), where the data gathered onboard is uploaded to a web based medical server, that allows a cumulative analysis of the data and distribution of the data over a network, such as the Internet.

FIG. 4 is a listing of the sequence of the health monitoring system for high speed craft (HMS HSC), where the data gathered on board is uploaded to a web based medical server, that allows a cumulative analysis of the data and distribution of the data over a network, such as the Internet. The sequence is as follows:

1. Inexpensive RFID transponders (tags) worn by crew members or other individuals.
2. The central data acquisition apparatus (on each HSC) tracks each RFID tag.
3. System's central data acquisition apparatus also measures HSC dynamic exposure, displays this information as a risk to injury, and correlates with each person onboard.
4. Individual exposure data is periodically uploaded (via jumpstick and the like) to a web based medical server.
5. Individual exposure data is combined with previous exposure data (may be from other boats) to determine a "cumulative dose" using a derivative of ISO 2631 P5 (Cumulative-R Algorithm) and
6. Medical personnel monitor individuals' cumulative dose levels and provide medical feedback to operators and their commands. Information can be accessed online.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A health monitoring system for personnel on a boat, said system comprising:

one or more radio frequency identification (RFID) tags, where each of said RFID tags is configured to be attached to and uniquely associated with an individual;

a global positioning system (GPS) receiver;

a display;

a RFID reader;

a multi-axis sensor unit that is an accelerometer that measures dynamic exposure data which enables determination of impact, vibration and shock at a specified time interval;

a central data acquisition apparatus comprising:

a protective box that can be mounted on the boat, said protective box being waterproof, impervious to marine elements, and having a resilience to impact that is comparable or better than the resilience of the boat;

a first processor mounted inside the protective box and being in communication with the GPS receiver and the multi-axis sensor unit;

a second processor mounted inside the protective box and being in communication with the RFID reader which enables reading radio frequency signals from the one or more RFID tags and confirming a status of all individuals as being onboard or overboard based on said reading;

a bus that enables communication between the first processor and the second processor;

a removable data storage unit mounted inside the protective box and being in communication with at least one of said first processor and said second processor;

a cover permitting quick access to the interior of the protective box and to the removable data storage unit;

a passive cooling system coupled to the first processor and the second processor;

a plurality of waterproof communication ports comprising electrical connections through the protective box from the first processor and the second processor to the display, the RFID reader, the GPS receiver, and the multi-axis sensor unit;

a first application that correlates each individual with the dynamic exposure data as measured by the multi-axis sensor unit, and saves the dynamic exposure data on the removable data storage unit;

a second application that records a GPS location and time if one or more individuals are overboard based on radio frequency signals received by the RFID reader, and generates a course to the GPS location for each of the one or more individuals; and a third application that graphically illustrates a ride roughness in terms of injury potential based on the dynamic exposure data at a particular speed and heading, and graphically provides a notification indicative of one or more individuals are overboard if so confirmed on the display;

wherein the ride roughness includes a cumulative time of whole-body vibration embedded with multiple shocks with the degree of injury, and an elapsed safe ride time, both based on the dynamic exposure data; and wherein the notification comprises an overboard indicator is lighted up to indicate a number of the one or more individuals are overboard and other information including an elapsed duration of time and the GPS location for each of the one or more individuals when one or more individuals are overboard, a distance of the boat to the GPS location, and a heading of the boat to return to the GPS location.

2. The system according to claim 1, wherein said removable data storage unit is a USB flash drive.

3. The system according to claim 2, wherein said USB flash drive is water proof.

4. The system according to claim 2, wherein said dynamic exposure data stored on the USB flash drive is encrypted.

5. The system according to claim 1 further comprising a web based medical server, where the dynamic exposure data is periodically uploaded therein maintaining an ongoing cumulative dynamic exposure dose level for the individual.

6. The system according to claim 5, wherein a USB flash drive that was plugged into the removable data storage unit contains the dynamic exposure data that is uploaded to the web based medical server.

7. The system according to claim 1, wherein the display is night vision goggle compatible.

8. The system according to claim 1, wherein the ride roughness in terms of injury potential based on the dynamic exposure data is calculated in terms of a spine stress dose value, and updated every ten seconds or more frequently.

9. The system according to claim 1 further comprising a fourth application that displays an error/status code into a user friendly text message on the display.

10. The system according to claim 1, wherein the RFID tag has a transponder.

11. The system according to claim 10 further comprising a transponder control capability to turn the transponder off and on if the boat is operating in a radio silence mode.

12. A health monitoring system for personnel on a boat, said system comprising:

one or more radio frequency identification (RFID) tags, where each of said RFID tags is configured to be attached to and uniquely associated with an individual;

a global positioning system (GPS) receiver;

a display;

a RFID reader;

a removable data storage unit comprising at least one waterproof USB flash drive;

a multi-axis sensor unit that is an accelerometer that measures dynamic exposure data which enables determination of impact, vibration and shock at a specified time interval;

a central data acquisition apparatus comprising:

a protective box that can be mounted on the boat, said protective box being waterproof, impervious to marine elements, and having a resilience to impact that is comparable or better than the resilience of the boat;

a first processor mounted inside the protective box and being in communication with the GPS receiver and the multi-axis sensor unit;

a second processor mounted inside the protective box and being in communication with the RFID reader which enables reading radio frequency signals from the one or more RFID tags and confirming a status of all individuals as being onboard or overboard based on said reading;

a bus that enables communication between the first processor and the second processor;

a cover permitting quick access to the interior of the protective box;

a passive cooling system coupled to the first processor and the second processor;

a plurality of waterproof communication ports comprising electrical connections through the protective box from the first processor and the second processor to the display, the RFID reader, the GPS receiver, the multi-axis sensor unit, and the removable data storage unit;

a first application that correlates each individual with the dynamic exposure data as measured by the multi-axis sensor unit, and saves the dynamic exposure data on the removable data storage unit;

a second application that records a GPS location and time if one or more individuals are overboard based on radio frequency signals received by the RFID reader, and generates a course to the GPS location for each of the one or more individuals; and a third application that graphically illustrates a ride roughness in terms of injury potential based on the dynamic exposure data at a particular speed and heading, and graphically provides a notification indicative of one or more individuals are overboard if so confirmed on the display;

wherein the ride roughness includes a cumulative time of whole-body vibration embedded with multiple shocks with the degree of injury, and an elapsed safe ride time, both based on the dynamic exposure data; and wherein the notification comprises an overboard indicator is lighted up to indicate a number of the one or more individuals are overboard and other information including an elapsed duration of time and the GPS location for each of the one or more individuals when one or more individuals are overboard, a distance of the boat to the GPS location, and a heading of the boat to return to the GPS location; and wherein the removable data storage unit is located external to the protective box and is in communication with at least one of said first processor and said second processor.

13. The system according to claim 12 further comprising a web based medical server, where the dynamic exposure data is periodically uploaded therein maintaining an ongoing cumulative dynamic exposure dose level for the individual.

14. The system according to claim 13, wherein the USB flash drive contains the dynamic exposure data that is uploaded to the web based medical server.

15. The system according to claim 12, wherein the display is night vision goggle compatible.

16. The system according to claim 12, wherein the ride roughness in terms of injury potential, based on the dynamic exposure data, is calculated in terms of a spine stress dose value, and updated about every five seconds or more frequently.

17. The system according to claim 12 further comprising a fourth application that displays an error/status code into a user friendly text message on the display.

18. The system according to claim 12, further comprising an RFID tag control capability to turn the RFID tag off and on if the boat is operating in a radio silence mode.

* * * * *